United States Patent [19]

Wolma

[11] 4,155,203

[45] May 22, 1979

[54] FASCIA

[75] Inventor: Rodney J. Wolma, Grand Rapids, Mich.

[73] Assignee: Philip L. Johnson, Grand Rapids, Mich.

[21] Appl. No.: 855,834

[22] Filed: Nov. 30, 1977

[51] Int. Cl.[2] ..... E04B 7/02; E04D 13/15

[52] U.S. Cl. ..... 52/60; 52/94

[58] Field of Search ..... 52/58, 60, 96, 95, 94, 52/97, 300

[56] References Cited

U.S. PATENT DOCUMENTS

| | | | |
|---|---|---|---|
| 2,250,951 | 7/1941 | Guignow | 52/97 |
| 2,734,602 | 2/1956 | Dawson | 52/97 |
| 3,012,376 | 12/1961 | Reddy | 52/97 |
| 3,237,352 | 3/1966 | Edwards | 52/97 |
| 3,405,485 | 10/1968 | Edwards | 52/96 |
| 3,680,269 | 8/1972 | Fischer | 52/94 |
| 3,738,068 | 6/1973 | Attaway | 52/94 |
| 3,766,694 | 10/1973 | Miwialoff | 52/95 |
| 3,802,140 | 4/1974 | Hickman | 52/96 |
| 3,862,531 | 1/1975 | Attaway | 52/58 |
| 3,992,827 | 11/1976 | Johnson | 52/94 |
| 4,067,152 | 1/1978 | Wolma | 52/96 |

*Primary Examiner*—John E. Murtagh

*Attorney, Agent, or Firm*—Price, Heneveld, Huizenga & Cooper

[57] ABSTRACT

A fascia for the edge of a roof is adapted to mount over an anchoring cant having an outwardly extending lip for lockably receiving a hook at the lower portion of the fascia member. The fascia extends upwardly and rearwardly over the cant and includes an integral locking member having a downwardly and forwardly extending edge which compressively grips a rear surface of the cant member locking the fascia member in position.

6 Claims, 3 Drawing Figures

FASCIA

BACKGROUND OF THE INVENTION

The present invention relates to the construction of roof edges of a building and particularly to improved fascia therefore.

In commercial buildings of modern construction, extruded aluminum fascia members for decorative edges of a roof are now common. Typically, the decorative fascia is interlocked over a cant or anchoring member which typically forms a seal with the roofing material. In anchoring the fascia over the cant member, it is desired that there be no fastening members which extend through the fascia so as to permit a path for leakage of water into the underlying roof structure. Accordingly, a variety of fascia structures have been suggested which provide a snap lock coupling to the supporting cant member. U.S. Pat. No. 3,992,827 issued Nov. 23, 1976, to P. Johnson; U.S. Pat. No. 3,862,531 issued Jan. 28, 1975, to Attaway et al; and U.S. Pat. No. 3,405,485 issued Oct. 15, 1968, to H. Edwards are representative of snap lock fascias which generally include a hook at one end for hooking to a lower outwardly projecting lip of the cant member and are generally U-shaped with a hook at the opposite end extending under another projection of the cant to snap lock the fascia to the cant. U.S. Pat. No. 3,012,376 issued Dec. 12, 1961, to C. A. Reddy et al provides a snap-on coping in which the junction of two walls of the coping engage the edge of a vertical mounting plate to secure the coping in place.

Although such systems are satisfactory in performance, the utilization of locking members of U-shaped construction with locking members at opposite ends of the legs of the U-shaped construction is quite difficult for the worker in the field to snap into position requiring in most cases specialized pry bars or tools to facilitate installation.

SUMMARY OF THE INVENTION

The present invention overcomes the difficulties of the prior art fascia by providing a fascia which snap locks over an anchoring cant without the use of specialized tools and compressively engages the cant by means of forwardly and downwardly projecting locking means having an edge spaced to compressively engage the cant between a front wall portion of the fascia and the edge of the locking means. With such construction, the fascia construction can be simplified thereby reducing its cost and a fascia is provided which is relatively easily installed without special tools.

The various features and advantages of the present invention can best be understood by reference to the following description thereof together with the accompanying drawings in which:

DETAILED DESCRIPTION OF THE PREFERRED EMBODIMENT

Figure 1:
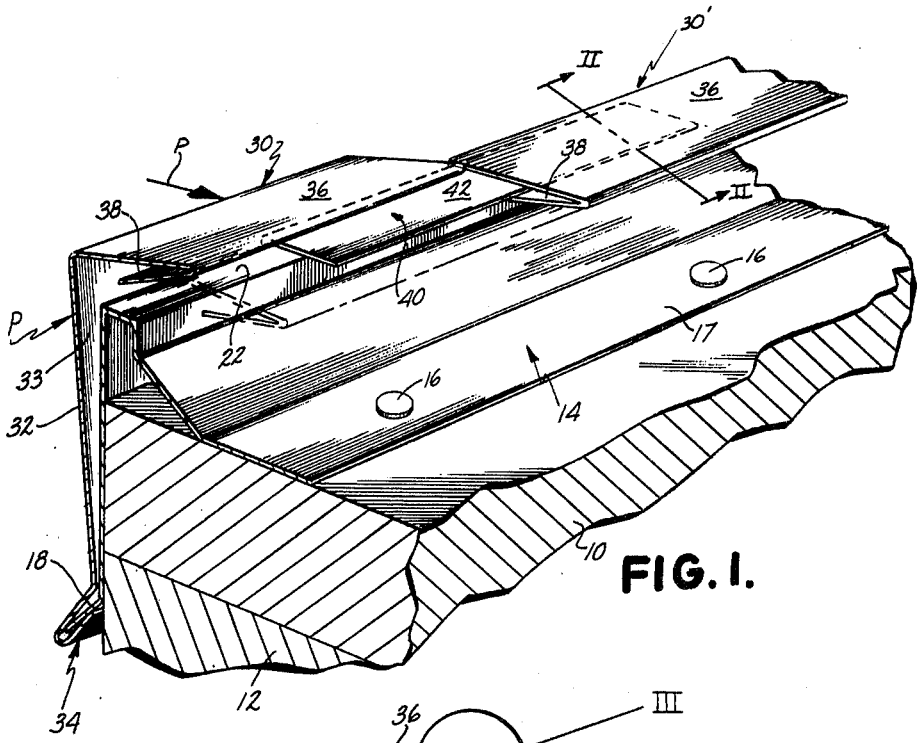
FIG. 1 is a fragmentary rear perspective view showing two sections of fascia embodying the present invention during different stages of installation.
Figure 2:
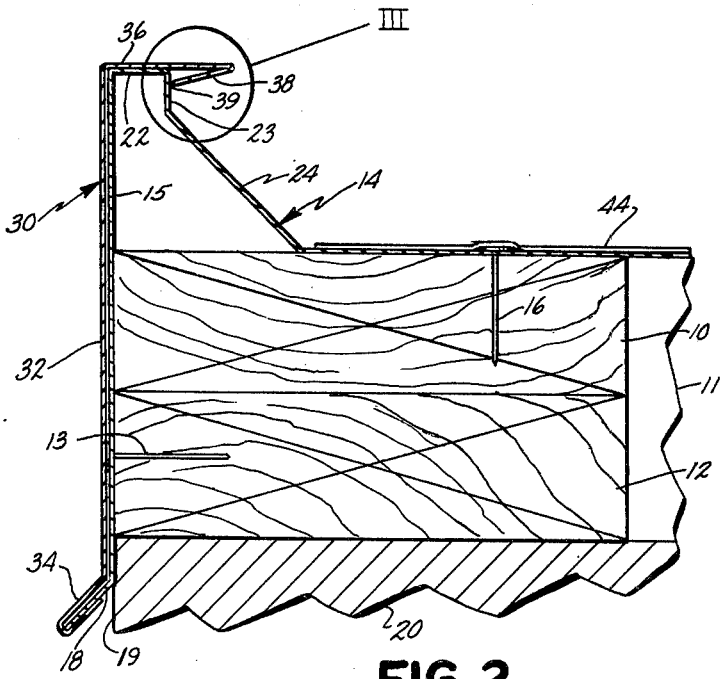
FIG. 2 is a cross-sectional view of the present invention taken along the section lines II—II of FIG. 1.

Referring now to FIGS. 1 and 2, there is shown a typical roofing installation by which a pair of vertically stacked nailers 10 and 12 are provided at the junction of a roof 11 and outer wall 20. A cant 14 is secured by means of nails 13 securing the front wall 15 of the cant to the front surface of the nailers and vertically and downwardly extending nails 16 securing a rear leg 17 of cant 14 to nailer 10. Cant 14 further includes attachment means comprising an outwardly and downwardly extending lip 18 extending along its length and projecting outwardly from the front surface 19 of the building's wall 20. At the top of wall 15 of cant 14 is a rearwardly and horizontally extending intermediate section 22 extending at right angles in the preferred embodiment from front wall 15 rearwardly a distance to give the cant some horizontal thickness. Integral with intermediate section 22 of the cant and joined at an end remote from its junction with front wall 15 is a downwardly depending rear wall 23 extending generally parallel to the front wall 15. Integrally secured to the downwardly depending wall 23 is an inclined downwardly and rearwardly projecting section 24 which extends downwardly until it joins the top surface of nailer 10 whereupon it is integrally joined with the flange 17.

Snap fitted over cant 14 is the improved fascia 30 of the present invention which includes a front wall 32 having means 34 at its lower end for securing it to the cant. Means 34 in the preferred embodiment comprises a U-shaped segment circumscribing the edge of lip 18 of cant 14. Front wall 32 extends vertically a distance substantially coextensive with wall 15 of cant 14 andincludes a rearwardly extending intermediate section 36 integrally joined with front wall 32 and extending substantially at right angles to the front wall. Integrally formed with the fascia and joined at the end of intermediate section 32 remote from its junction with front wall 32 is locking means 38 which, in the preferred embodiment, comprises a flange which extends forwardly and downwardly and has a lineally extending edge 39 which compressively engages the rear surface 23 of cant 14. Thus, edge 39 and the rear surface 33 of the front wall 32 of the fascia compressively hold the walls 15 and 23 of the cant therebetween. Flange 38 forms an acute angle with intermediate section 36.

Figure 3:
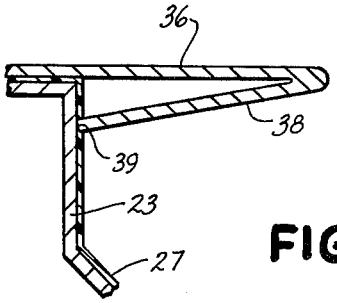
FIG. 3 is an enlarged fragmentary view of the locking portion of the fascia encircled in FIG. 2.

In the preferred embodiment, the fascia 30 is integrally formed and extruded of aluminum having a thickness of 0.032 or 0.040 inches to be stiffly resilient and is cut in 10 foot sections. In FIG. 1 there is shown two sections 30 and 30' with a concealed cover plate 40 positioned over the cant 14 at the junction of the two strips of fascia. The concealed cover plate 40 has a horizontal surface 42 overlying the intermediate section 22 of the cant and a downwardly forwardly extending front wall (not shown) which terminates in a lip coextensive with lip 18 of the cant. The purpose of cover plate 40 is to provide sealing and esthetic appearance to the junction of fascia sections. The cover plate is finished in the same color and texture as the fascia member. During installation, as best seen in FIGS. 1 and 3, the locking means 34 of the fascia is first hooked over lip 18 of the cant installed as previously discussed. Next the fascia is pressed at an area and in a direction indicated by arrow P in FIG. 1 such that the edge 39 of locking segment 38 rides over the top of intermediate section 22 of the cant resiliently bending the junction of walls 32 and 36 open as necessary and then snaps downwardly such that edge 39 digs into the rear surface 23 of the cant. In the preferred embodiment, cant 14 is coated with a layer 27 of polyvinyl chloride (PVC). Edge 39 actually maintains pressure against the PVC making a tight, sealed and locked interconnection between the fascia and cant. A sheet 44 of polyvinyl chloride completes the roofing installation, and as seen in FIG. 2, overlays nails 16 extending through lip 17 of the cant. Sheet 44 is suitably bonded to the PVC layer 27 on the cant 14 by means of conventional bonding adhesive.

In one embodiment of the invention, the distance between the walls 15 and 23 of the cant was approximately ¾ inch and the distance from edge 39 to the inner surface 33 of front wall 24 of the fascia was 1/32 inch less. Naturally, depending upon the distance between the front and rear surfaces of the cant 14, section 36 and the locking flange 38 of the fascia can have widths accordingly to provide the desired compression for locking the fascia to the cant. In some installations where standard roofing felts are used in place of the PVC sheet 44, the roofing felts will extend up under edge 39 of the locking member.

It will become apparent to those skilled in the art that these and other modifications to the present invention can be made without departing from the spirit or scope of the invention as defined by the appended claims.

The embodiments of the invention in which an exclusive property or privilege is claimed are defined as follows:

1. A fascia assembly comprising:

a cant for attachment to the edge of a roof and including front and rear generally vertical surfaces spaced from one another joined by a top surface, said cant including attachment means generally at the bottom of said front surface; and a fascia member including a front wall having means for securing said front wall to said attachment means of said cant, said front wall extending along and generally adjacent said front surface of said cant; a rearwardly depending section joined to said front wall and extending generally laterally rearwardly therefrom, over said top surface and beyond the juncture of said top surface with said rear surface of said cant; and a downwardly and forwardly extending flange joined at one end to said rearwardly depending portion; said flange having an edge spaced from said front wall a distance just slightly less than the spacing between said front and rear surfaces of said cant such that only said edge compressively engages said rear surface of said cant to secure said fascia member to said cant; said fascia terminating at said edge, and said edge engaging said rear surface of said cant a sufficiently short distance below said top surface of said cant that said downwardly and forwardly extending flange can be snapped over said top surface of said cant and into position behind and engaging said rear surface of said cant.

2. The apparatus as defined in claim 1 wherein siad edge of said fascia flange comprises a lineally extending edge and said cant is coated with plastic whereby said lineal extending edges tends to seal against said plastic coating.

3. The apparatus as defined in claim 2 wherein said front wall of said fascia is substantially coextensive with said front surface of said cant.

4. The apparatus as defined in claim 3 wherein said cant includes a front wall, a rearwardly extending intermediate wall and a downwardly extending rear wall and said front surface is the exterior surface of said front wall of said cant and said rear surface is the exterior surface of said rear wall of said cant.

5. The apparatus as defined in claim 4 wherein said attachment means of said cant comprises a lip and wherein said securing means of said fascia comprises an integral U-shaped member extending over said lip to secure said end of said fascia of said cant.

6. The fascia as defined in claim 1 wherein said fascia is extruded of aluminum.

* * * * *